United States Patent [19]

Burillo et al.

[11] 4,333,427

[45] Jun. 8, 1982

[54] INTERNAL COMBUSTION ENGINE

[76] Inventors: Antonio Burillo, 127 Monterey Rd., S. Pasadena, Calif. 91030; Richard Dane, II, Alhambra, Calif.

[21] Appl. No.: 175,585

[22] Filed: Aug. 5, 1980

[51] Int. Cl.[3] ..... F01L 7/00

[52] U.S. Cl. ..... 123/190 A; 123/190 E; 123/80 BA

[58] Field of Search ..... 123/80 R, 80 BA, 190 R, 123/190 A, 190 B, 190 BA, 190 BB, 190 E; 403/359

[56] References Cited

U.S. PATENT DOCUMENTS

| | | | |
|---|---|---|---|
| 1,218,296 | 3/1917 | Moorhead | 123/190 A |
| 1,259,063 | 3/1918 | Winkle | 123/190BB |
| 3,582,116 | 6/1971 | Young | 403/359 |
| 3,892,220 | 7/1975 | Franz | 123/190 E |
| 3,989,025 | 11/1976 | Franco | 123/190 E |
| 4,077,382 | 3/1978 | Gentile | 123/190 A |

FOREIGN PATENT DOCUMENTS

| | | | |
|---|---|---|---|
| 660525 | 11/1951 | United Kingdom | 123/190 BB |

*Primary Examiner*—Craig R. Feinberg
*Assistant Examiner*—W. R. Wolfe
*Attorney, Agent, or Firm*—Bruce L. Birchard

[57] ABSTRACT

By utilizing rotary valves comprising synchronized, slotted intake and exhaust shafts (which may be segmented) and associated sealed, fixed ported cups instead of reciprocating valves the efficiency and reliability of an internal combustion engine is significantly increased.

8 Claims, 12 Drawing Figures

INTERNAL COMBUSTION ENGINE

BACKGROUND OF THE INVENTION

1. Field of the Invention

This invention relates to internal combustion engines and particularly to such engines with rotary valving systems.

2. Prior Art

Motorcycle engines often have a simplified form of rotary valving but such engines are not subject to the problems involved in larger internal combustion engines such as those found in automobiles, trucks and airplanes.

A Patent Office search directed to rotary valves revealed the following patents:

| U.S. Pat. No. | Inventor | Date of Issuance |
|---|---|---|
| 1,011,748 | Coffin | Dec. 12, 1911 |
| 1,477,591 | Prescott | Dec. 18, 1923 |
| 1,923,480 | Fish | Aug. 22, 1933 |
| 2,369,147 | Klas | Feb. 13, 1945 |
| 3,948,227 | Guenther | April 6, 1976 |

None of the listed patents, except Guenther recognize the importance of sealing such a rotary valve and, hence, none of such rotary valves will operate in the high compression environment contemplated by this invention, as claimed.

Turning to Guenther, U.S. Pat. No. 3,948,227, he fails to disclose or suggest continuous sealing by carrying the seals on the rotating shaft. His fixed seal would not give continuous sealing and pressure losses would result. Further, his one piece shaft would be difficult and expensive to replace. Additionally, Guenther will suffer shaft wear necessitating shaft machining.

Therefore, it is an object of this invention to overcome the general disadvantages of the prior art.

It is a further object of this invention to provide, for internal combustion engines, an improved rotary-valve system.

It is a still further object of this invention to provide, for an internal combustion engine a rotary-valve system which will have high reliability under high engine-speed conditions, will assure high volumetric and thermal efficiency and will be easy and inexpensive to maintain.

SUMMARY OF THE INVENTION

Stated succinctly, the present invention contemplates separate rotary inlet and exhaust valves for each cylinder in an internal combustion engine, each valve being composed of a slot in a segmented shaft, which shaft is rotatable, each slotted portion of the shaft being enclosed by a cup having appropriate ports therein for desired gaseous influx or efflux therethrough, each such slotted shaft-cup combination containing rotating sealing means therein for preventing leakage of gaseous materials (either air-fuel mixture or exhaust gases) from or into the combustion chamber of the associated engine.

BRIEF DESCRIPTION OF THE DRAWINGS

The present invention, both as to its nature and scope, may best be understood by reference to the description, herein, taken in connection with the accompanying drawings, in which.

DESCRIPTION OF THE PREFERRED EMBODIMENT

Figure 1:
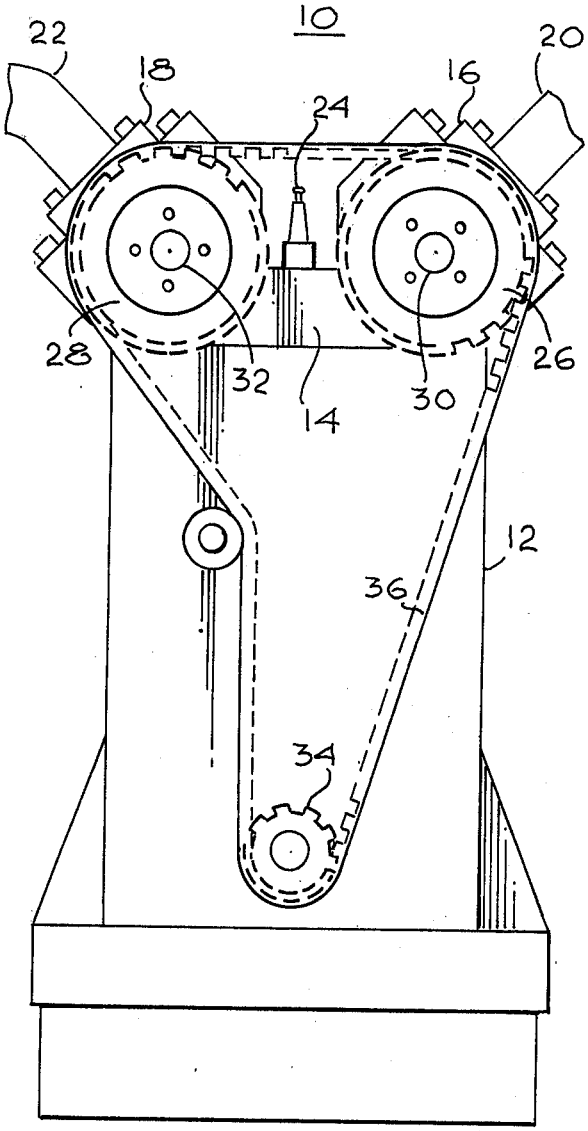
FIG. 1 is an end view of an engine incorporating the rotary valving system according to this invention.

In FIG. 1, engine 10 includes block 12 having combustion chambers therein, not shown and head 14. Head 14 carries inlet manifold 16 and exhaust manifold 18, thereon. Air-fuel mixture is introduced at intake 20 and exhaust gases are vented through a muffler, not shown, by way of exhaust pipes 22. A spark plug 24 is provided for each combustion cylinder.

Sprockets 26 and 28, which are carried on shafts 30, 32, respectively, are driven, in synchronism, from drive shaft 34 by means of timing chain 36. Shafts 30 and 32 contain slots, seen clearly in FIGS. 4 thru 7, which form part of the rotary valving system which is the subject of this invention.

Figure 2:
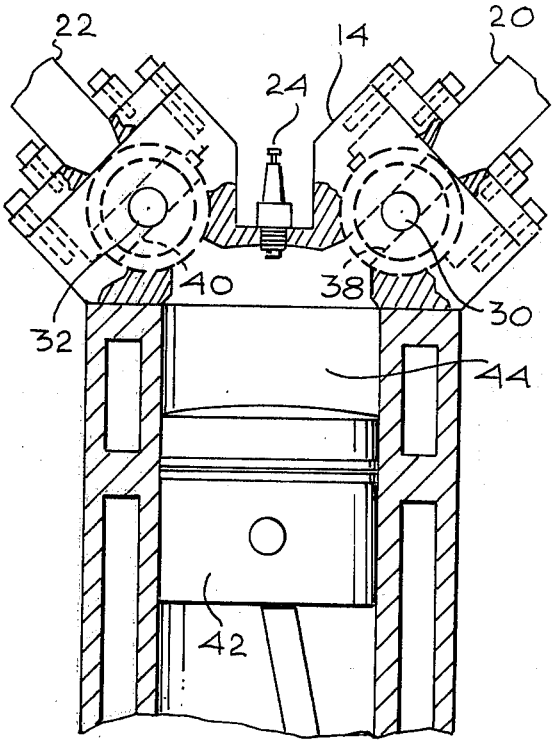
FIG. 2 is a partially cross-sectioned view of a portion of the engine of FIG. 1.

In FIG. 2, shaft 30 has slot 38 therein. Shaft 32 has slot 40 therein. Piston 42 moves within cylinder 44. As can be seen from FIG. 2, by reason of the fact that the conventional reciprocating valves have been replaced by rotary valves there is no valve intrusion into the combustion chamber and there is no chance of piston 42 hitting a valve, as there would be if a reciprocating valve were used. Consequently, cylinder 44 may be completely exhausted of waste gases and higher efficiency, lower pollution can be assured.

Figure 3:
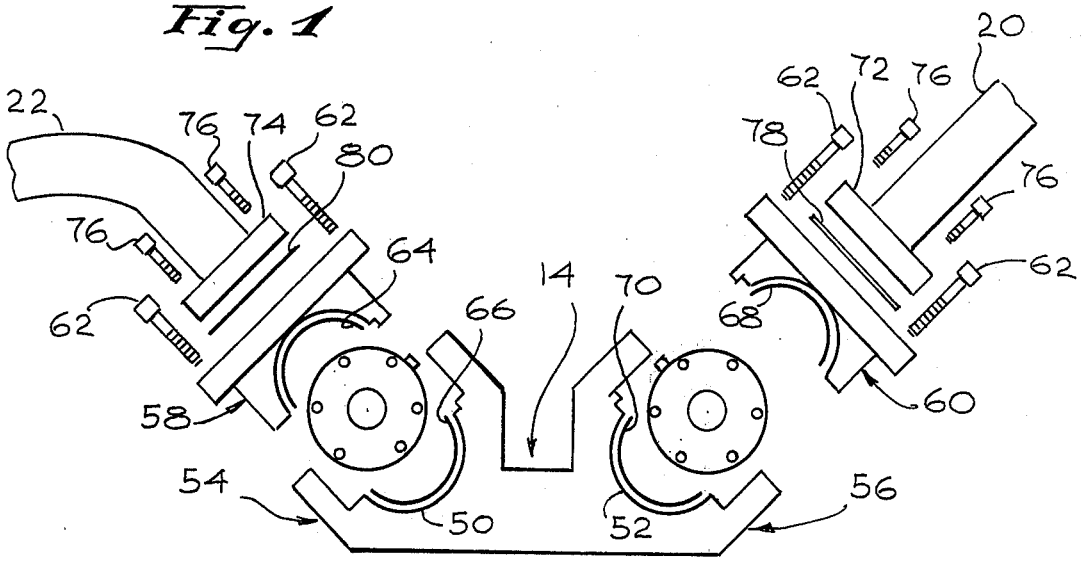
FIG. 3 is an exploded view of a portion of the engine of FIG. 1.

In FIG. 3, head 14 includes lower cover portions 50 and 52 of exhaust and inlet portions 54 and 56, respectively. Upper cover portions 58 and 60 are adapted to be joined with lower cover portions 54 and 56, respectively, by screws 62. Gaskets 64, 66, 68 and 70 assure gas-tight joints between the respective upper and lower covers and the various rotary valve sealing cups shown more clearly in FIGS. 4 to 7. Intake manifold 72 and exhaust manifold 74 are secured to covers 60 and 58, respectively, by bolts 76. Gaskets 78 and 80 assure no leakage of vapors at the intake and exhaust manifolds, respectively.

Figure 4:
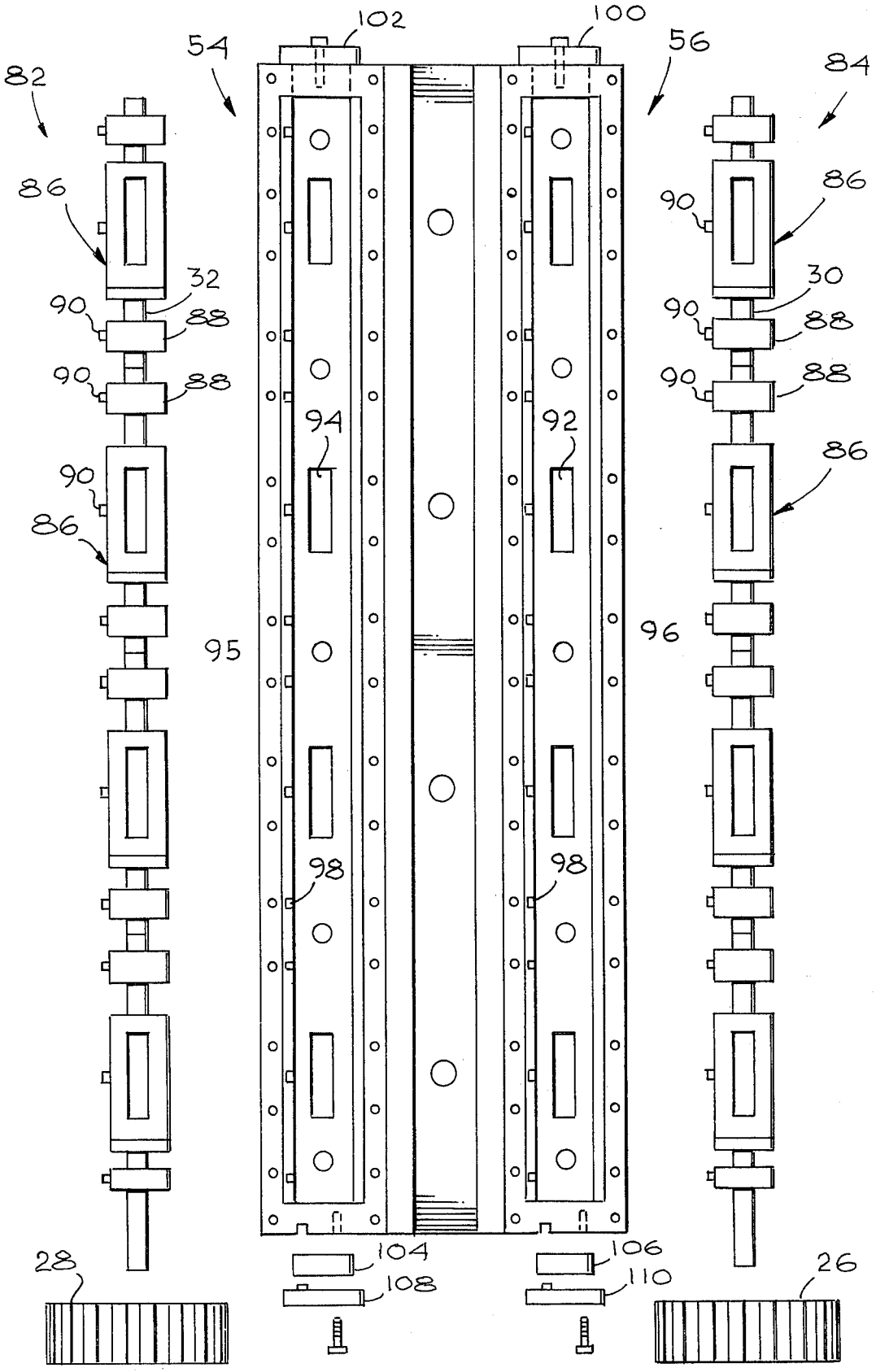
FIG. 4 is a plan view of the engine of FIG. 1 with the rotary-valve shafts displaced from their operating positions for ease of description.

In FIG. 4, upper or side covers 58 and 60 have been removed, exhaust valve assembly 82 and intake valve assembly 84 have been removed and lower portions 54 and 56 have been exposed. Rotary valve shaft assemblies 82 and 84 comprise rotary valve assemblies 86, shafts 32 and 30, respectively, and support bearings 88. In addition locating pins or dowels 90 are provided.

Inlet lower portion 56 has inlet ports 92 therein. Exhaust lower portion 54 has exhaust ports 94 therein. Holes 94 are provided to receive head bolts, not shown in this figure. Holes 96 in the inlet lower portion 56 are provided to receive headbolts, not shown in this figure.

Slots 98 are provided to receive locating pins or dowels 90.

Cover plates 100 and 102 are also provided. Bearings 104 and 106 and oil seals 108 and 110 are provided in connection with sprockets 28 and 26, respectively.

Figure 5:
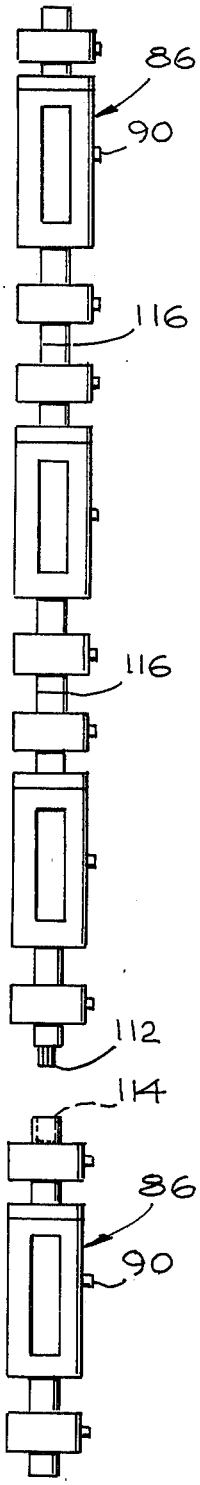
FIG. 5 is a plan view of a portion of the apparatus of FIG. 4 showing segmentation thereof.

In FIG. 5, it is clear that the valve shaft assembly, which may be either assembly 82 or 84 in FIG. 4, is segmented, with the contiguous valve and bearing combinations being coupled by means of keyed, splined shafts, with male portions 112 and female portions 114 forming joints 116.

Figure 6:
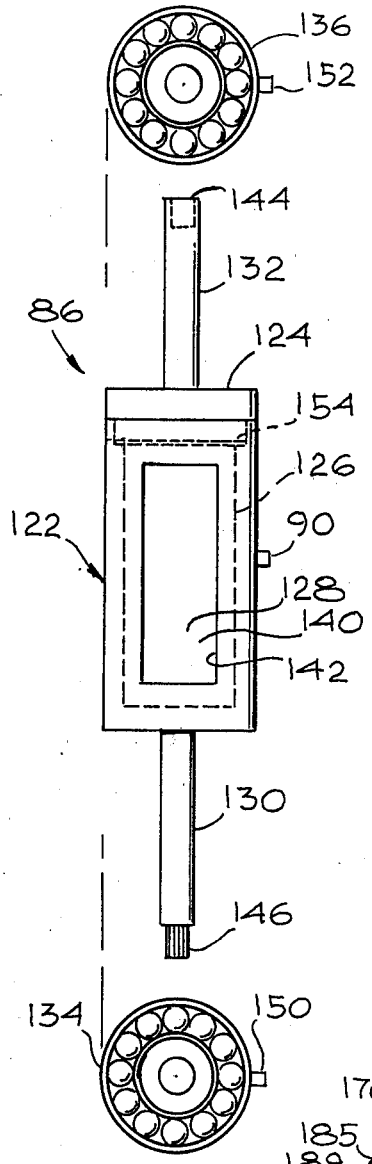
FIG. 6 is a schematic diagram of one valve—set for use in the engine of FIG. 1.

The structure of one rotary valve assembly is shown in FIG. 6.

Figure 6A:
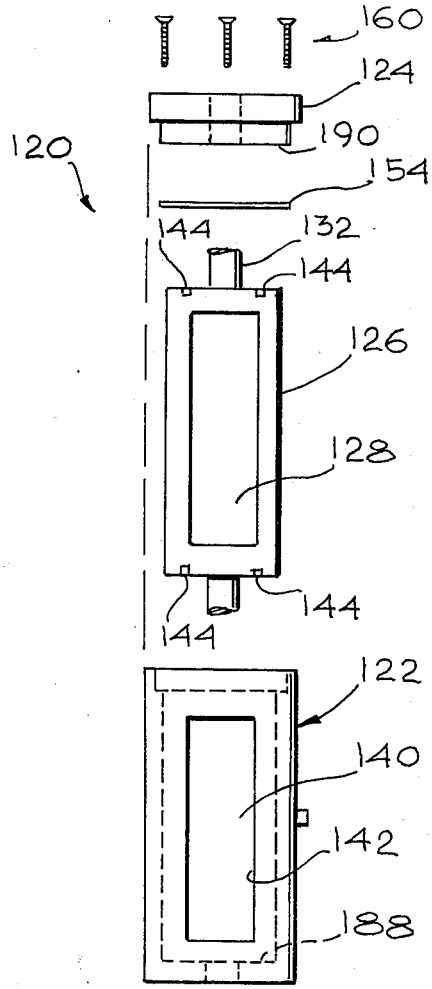
FIG. 6A is an exploded view of the valves of FIG. 6.

In FIG. 6, rotary valve assembly 86 includes sealing cup 122 having one removable end cap 124. Valve rotor 126 has a port 128 therein. Reduced portions of rotor 126 form rotor axles 130 and 132. Axles 130 and 132 are supported rotatably in axle bearings 134 and 136, respectively. Sealing cups 122 carries locating dowel or pin 90 thereon which secures the valve assembly 120 both longitudinally and rotationally when covers 16 or 18 (FIG. 2) are in position. Sealing cup 122 has a pair of oppositely disposed apertures 140, 142 therein designed to cooperate with port 128 in valve rotor 126. Shaft 132 terminates in a female splined and keyed portion 144. Shaft 130 terminates in a male splined and keyed portion 146. The splining assures non-slipping rotational force transmission between successive valve assemblies. The keying assures proper timing of opening of the respective valves when combined into the valve shaft assembly of FIG. 5. Locating dowels 150 and 152 secure axle bearings 134 and 136 from translation or undesired rotation. A gasket 154, which may be a Nitrogen-filled tube or ring, assures hermetic sealing between cap 124 and sealing cups 122. The inner cylindrical surface of cup 122 is machine finished to provide a surface over which the apex seals to be described hereinafter, may slide without leakage and with minimum wear. The details of construction of valve assembly 120 can be seen more clearly in FIG. 6A, which is an exploded view. Valve rotor 126 has port 128 extending diametrically therethrough. Cap 124 is secured to cup 122 by means of screws 160. Cup 122 has oppositely disposed ports 140 and 142. Terminators 144 form the closing seal between the apex seals adjacent port 128 and the side seals, which will be described more fully in connection with FIG. 7. Gasket 154 may be of conventional gasket material or a tube containing nitrogen which will expand with the heat derived from engine operation and cause the seal to be more complete.

Figure 7A:
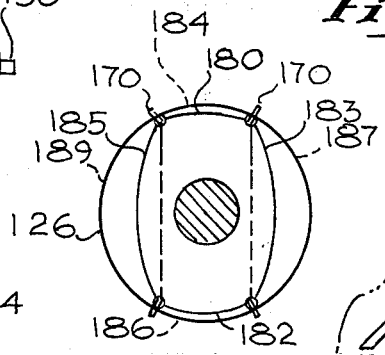
FIGS. 7, 7A, 7B, 7C and 7D show schematically, the sealing structure for the rotary valves of FIG. 6.
Figure 7B:
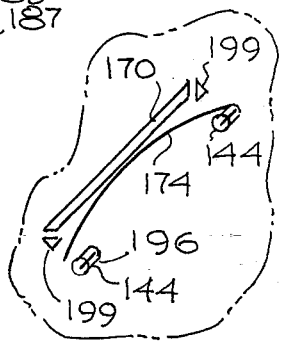
Figure 7:
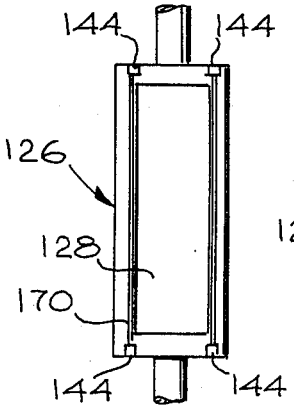

In FIG. 7, valve rotor 126 has eight terminators 144 held in receptacles 145 therein located in the opposite ends of rotor 126 adjacent four corners of port 128 and on the diametrically opposite extremities of that port. Terminators 144, which can be seen more clearly in FIG. 7B, have slots therein to receive the various seals that prevent gaseous leakage from the valve. For example, apex seals 170, which flank port 128 and extend more or less radially from rotor 126, are secured in terminators 144 and are urged toward the inner surface of cup 122 by spring means 174 shown diagrammatically in FIG. 7B.

In FIG. 7A, the various seals which confine the intake and exhaust gases to escape thru port 128 are shown. In addition to apex seals 170 there are side seals for both the long and short dimensions of port 128. The short side seals 180, 182 and their opposite numbers 184, 186, not shown; and the long side seals 183, 185 with their opposite numbers 187, 189, not shown, ride on the inner end faces 188 and 190 of cup 122 (FIG. 6A) thus preventing leakage of gases in an axial direction. They may be biased toward the respective inner faces of the end caps on sealing cup 122 by means of wave springs such as spring 192 shown in FIG. 7D.

Figure 7C:
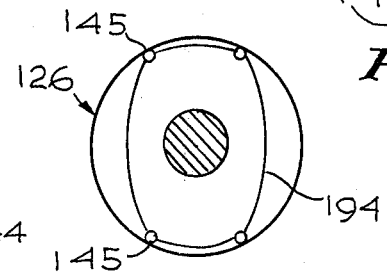
Figure 7D:
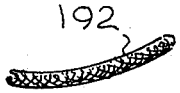

Those springs are carried in slots 194 on opposite ends of valve rotor 126 as shown, for one end, in FIG. 7C. Indentations 145 receive terminators 144 which have slots therein to receive the apex side and corner seals as shown in FIG. 7B.

There would be a potential leakage zone at the junction between the apex seals and the side seals were in not for the corner seals 199 which are also carried by terminators 144 in the slots carrying apex seals 170 and are urged toward the inner surfaces of end caps 188 and 190 by springs 174.

Because of the sliding contacts between the seals and the inner surfaces of sealing cup 122 and the high temperatures at which the valves must operate on the exhaust side attention must be paid to the material of which the seals and the cup are made. If the inner or bore surface of cup 122 has a surface of hard chrome the apex seals, and corner seals may be of carbon and the side seals of piston ring cast iron. The end cap and inner surfaces of rotor 126 may then be of molydenum.

While the sealing cup has been described as a separate unit, it may be cast (in two hemicylindrical parts) with the head.

While a particular embodiment of the invention has been shown and described it will be apparent to those skilled in the art that variations may be made without departing from the spirit and scope of the invention. For example, sealing cup 122 may be water cooled. It is the purpose of the appended claims to cover all such variations.

What is claimed is:

1. In an internal combustion engine having a plurality of combustion chambers:

an inlet lower cover portion having a first set of inlet ports communicating with respective ones of said combustion chambers;

an inlet upper cover having a second set of inlet ports respectively aligned, in operation, with said first set of inlet ports in said inlet lower cover portion;

an exhaust lower cover portion having a first set of exhaust ports equal in number to the number of said combustion chambers and communicating with respective ones thereof;

an exhaust upper cover having a second set of exhaust ports respectively aligned, in operation, with said first set of exhaust ports;

an intake valve shaft assembly including a plurality of rotary valves supported to communicate, in a predetermined time sequence, between the ports in said first set of inlet ports and respective ones of the ports in said second set of inlet ports;

an exhaust valve shaft assembly including a plurality of rotary valves supported to communicate, in a predetermined time sequence, between respective ones of said ports in said first and second sets of exhaust ports;

means for driving said intake and exhaust valve shaft assemblies synchronously with respect to each other;

said inlet and exhaust valve shaft assemblies being segmented between adjacent rotary valves;

each of said rotary valves including a rotor portion having a port passing diametrically therethrough, said rotor portion terminating in a pair of axles, and a cylindrical cap portion having inner and outer surfaces and being coaxial with and enclosing said rotor portion except for openings at opposite ends of said cup portion for passage of said axles therethrough and diametrically opposed ports positioned to communicate with said port in said rotor.

2. Apparatus according to claim 1 in which said cup portion has end caps, one of which is removable from said cup.

3. Apparatus according to claim 1 in which said cup portion carries a locating dowel extending radially outward from the outer cylindrical surface thereof.

4. Apparatus according to claim 1 in which said cup portion includes, in addition, sealing means between said rotor and said inner surfaces of said cup.

5. Apparatus according to claim 4 in which said sealing means includes apex seals carried parallel to the axis of said valve rotor and supported in the outer surface thereof.

6. Apparatus according to claim 4 which includes, in addition, terminators carried at the ends of said rotor for supporting said sealing means.

7. Apparatus according to claim 6 which includes, in addition, apex seals, side seals and corner seals supported in said terminators.

8. Apparatus according to claim 7 which includes, in addition, spring means carried by said rotor for urging said seals outwardly from said rotor.

* * * * *